United States Patent [19]

Arzola

[11] 4,167,831

[45] * Sep. 18, 1979

[54] MELODY BIRD INSTRUMENT

[76] Inventor: Rurico Arzola, Calle San Martin, No. 69-Urb. Villa Sol, Mayaguez, P.R. 00708

[ * ] Notice: The portion of the term of this patent subsequent to Jul. 5, 1994, has been disclaimed.

[21] Appl. No.: 794,708

[22] Filed: May 9, 1977

Related U.S. Application Data

[63] Continuation-in-part of Ser. No. 600,912, Jul. 31, 1975, Pat. No. 4,033,069.

[51] Int. Cl.[2] ..... A63H 5/00

[52] U.S. Cl. ..... 46/52

[58] Field of Search ..... 46/52, 66, 179

[56] References Cited

U.S. PATENT DOCUMENTS

| | | | |
|---|---|---|---|
| 138,365 | 4/1873 | Ball | 46/52 |
| 143,044 | 9/1873 | Waters | 46/179 |
| 157,095 | 11/1874 | Hawk | 46/52 |
| 1,257,448 | 2/1918 | Belton | 46/52 X |
| 2,727,333 | 12/1955 | Robles | 46/52 |

FOREIGN PATENT DOCUMENTS

| | | | |
|---|---|---|---|
| 534251 | 1/1922 | France | 46/52 |
| 2679 | of 1873 | United Kingdom | 46/52 |

*Primary Examiner*—F. Barry Shay

*Attorney, Agent, or Firm*—Craig and Antonelli

[57] ABSTRACT

An improved instrument is provided for simulating melodious and harmonious sounds of singing birds, such as tropical varieties and the sounds of nighttime insects and small animals, such as the Puerto Rican "coqui". This instrument includes a construction of a plurality of axially aligned air chambers, each having an opening with beveled edges having a bevel angle of 30° into the interior of the respective air chambers, so that upon movement of the instrument through the air by swinging and rotating, a wide variety of melodious and harmonious sounds are produced resembling those of birds and nighttime insects and animals. The plurality of air chambers may be cylindrical, conical or a combination of cylindrical and conical air chambers, and further each air chamber may be sub-divided into two, three, or four sub-chambers, wherein each sub-chamber also includes one opening having beveled edges with a bevel angle of 30° into the interior of the sub-chamber.

31 Claims, 49 Drawing Figures

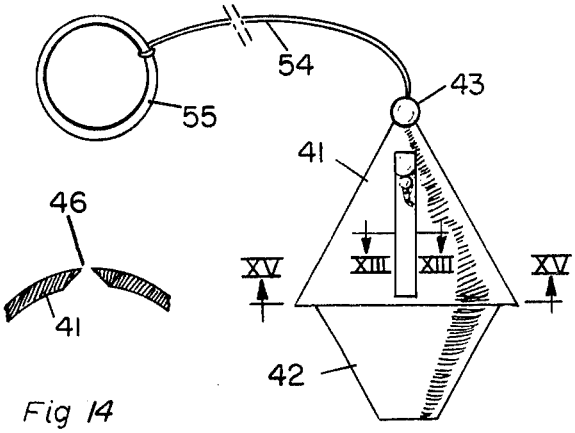
Fig 14
Fig 13
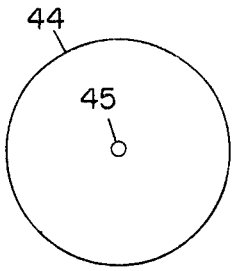
Fig 15
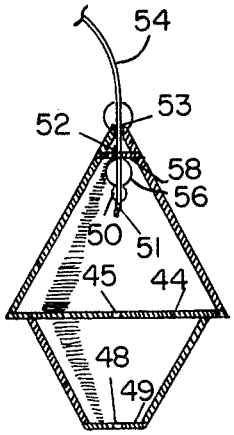
Fig 16
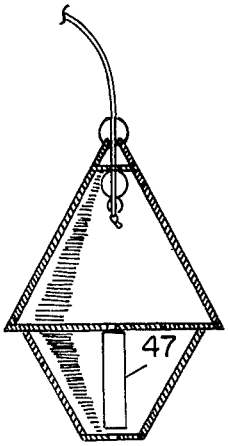
Fig 17

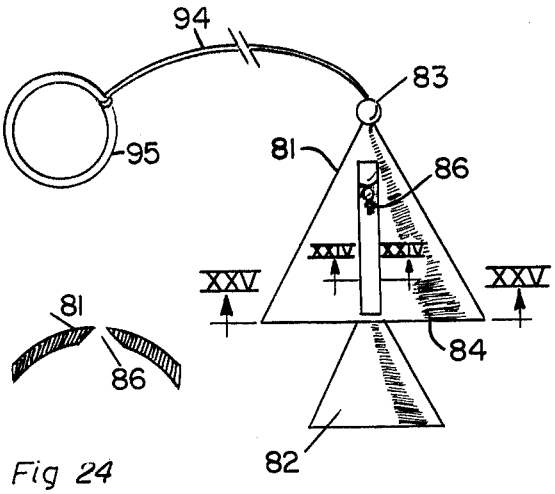
Fig 23
Fig 24
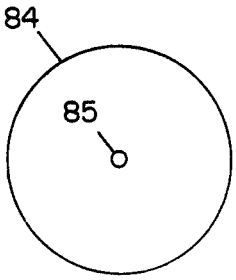
Fig 25
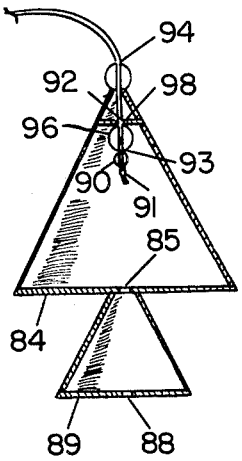
Fig 26
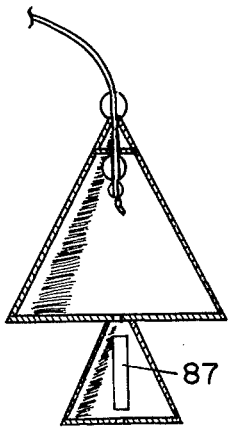
Fig 27

MELODY BIRD INSTRUMENT

This application is a continuation-in-part of my copending U.S. patent application Ser. No. 600,912, filed July 31, 1975, now U.S. Pat. No. 4,033,069 the subject matter of which is hereby incorporated by reference, and the benefit of the earlier filing date is hereby claimed for all common subject matter.

The present invention relates to an instrument or device for obtaining melodious and harmonious sounds, such as those resembling the sounds of tropical birds and animals, particularly of the type provided in my above-mentioned patent. More particularly, the present invention involves improvements in the construction for this instrument by using a number of sound producing chambers in order to increase the variety of sounds imitating birds and small nighttime insects or animals, such as the little frog or "coqui" of Puerto Rico.

The melody bird instrument of my above-mentioned patent produces various sounds of melodious birds and insects by means of a construction having a central air chamber with a longitudinal aperture for passage of air and a small aperture at one end of the air chamber through which air circulates with respect to a hollow base conical member having an open base portion. The longitudinal aperture of my aforementioned patent includes a pair of beveled edges having a bevel angle of 30° into the interior of the air chamber. This previous assembly further included a front conical section attached to the end of the air chamber opposite to the base conical section, and a holding member, such as a string, is attached at the front conical section for operation of the device by rotating the device about its longitudinal axis and swinging the device through the air at the end of the string. The sounds produced can be varied by varying the rotation and speed of rotation of the device which swings through the air by increasing or decreasing wrist and arm rotation of the user's hand holding the end of the string.

The present invention seeks to improve this prior device of my patent by constructing a plurality of air chambers, each of which includes an aperture for passage of the air in the air chamber, which aperture also includes beveled edges having a bevel angle of 30° into the interior of the respective air chamber. The plurality of air chambers are axially aligned, and may be provided in the form of axially adjoining cylindrical chambers, conical chambers, and combinations of cylindrical and conical chambers. Further, the chambers may be divided into two, three or four sub-chambers, each having one of the beveled apertures for passage of air, and the number of sub-chambers in axially adjoining chambers can be the same or different. This improved construction of the present invention considerably increases the variety of the produced sounds and increases the quality of imitation of a wider number of birds and animals.

While the melody bird instrument of my above-mentioned patent achieves simulation of sounds of birds and nighttime animals and insects through the use of single central air chamber having an elongated aperture, the present invention considerably improves this structure by the use of the plurality of axially aligned air chambers, which can be further subdivided, wherein all of the chambers or sub-chambers include a 30° beveled edge aperture, either in the form of an elongated aperture as in my patent, or in a row of circular openings into the interior of the respective chamber or sub-chamber.

The use of different sized chambers for toy whistles has been previously contemplated in U.S. Pat. No. 143,044 to Waters and U.S. Pat. No. 157,095 to Hawk. Each of these prior toy devices relies on the presence of air chambers of different diameters to produce a variation in sound, and neither provides a construction having apertures in the chambers with beveled angles of 30°, as does both the melody bird instrument of my aforementioned patent, and the present application.

A toy has been further contemplated in the patent to Lee, U.S. Pat. No. 140,206, in which a cylindrical chamber is provided with a whistle chamber at one end being constructed of disks with central orifices so as to create a whistle upon the flow of air therethrough. This construction also does not provide the use of apertures with beveled edges having a bevel angle of 30°, nor can the prior art toy by Lee achieve variation in the produced sounds since the construction of the whistle is permanent so as to always produce the same whistle sound.

The improved melody bird instrument of the present invention, on the other hand, is able to produce a considerable variety of sounds by the construction of the plurality of axially aligned air chambers which may be further subdivided, and each of the air chambers and/or sub-chambers being provided with an opening into the chamber having beveled edges with a bevel angle of 30°. Consequently, the improved melody bird instrument of the present invention is extremely useful in instruction of science and biology courses, including both physics and ornithology, since the sounds of melodious birds, for example, can be reproduced in the classroom without requiring out-of-doors field study. Moreover, students of ornithology may become familiar with the sounds and calls of a number of birds not easily accessible, which sounds may be produced quite well with the improved melody bird instrument of the present invention.

Furthermore, the construction of the present invention finds considerable use in simulation of bird and animal sounds for background sound tracks in movies and sound cassettes. In addition, the improved melody bird instrument of the present invention achieves a quite entertaining toy for children, which may be also quite educational.

The construction of the improved melody bird instrument of the present invention may be achieved by a plurality of axially aligned cylindrical chambers, which may be further subdivided by constructing axially extending partitions within each cylindrical chamber. The arrangement of the apertures in the plurality of axially aligned air chambers has been further found to be advantageous where the apertures have different circumferential locations with respect to one another, such as for example the aperture of one chamber is located at the front of the instrument, whereas the aperture of the next or another chamber is located at the rear of the instrument.

In a further advantageous construction, a central chamber including at least one cylindrical air chamber may be provided with conical air chambers at the respective opposite axial ends. These conical air chambers are also provided with elongated apertures having beveled edges with the bevel angle of 30°, and the location of the apertures also may be varied circumferentially about the instrument. In such a construction, the conical air chambers may be truncated with the larger diameter base being attached to the cylindrical end of the central air chamber or the smaller diameter base being attached to the axial end of the cylindrical chamber. Subdivision of the various air chambers in this construction can also be provided.

In another advantageous construction of the improved melody bird instrument of the present invention, conical air chambers may be axially adjoined, particularly with the conical bases of two respective conical chambers being attached to one another. In this regard, either or both of the conical chambers may be truncated, and the larger diameter base of one may be smaller or the same as the larger diameter base of the other, but in all cases the respective larger diameter conical base of each conical chamber is attached to the other, so as to construct an instrument resembling a satellite module, for example.

In this construction of the adjoining conical air chambers for the improved melody bird instrument of the present invention, each of the conical air chambers includes an aperture having beveled edges with a bevel angle of 30°. The aperture may be elongated, and the apertures of the two conical air chambers may be circumferentially located oppositely from one another, such as to have one aperture facing the front of the instrument, while the other aperture faces the rear of the instrument.

Moreover, this construction of conical air chambers may be also provided with subdivisions of the conical chambers by providing axially extending partitions dividing the conical chamber into two, three, or four sub-chambers. In addition, partition walls may be provided perpendicularly to the axis to subdivide each of the two conical chambers forming the instrument, wherein at least one of the axially subdivided conical chambers may further be subdivided by the longitudinally or axially extending partitions. In each of these cases, the respective chamber or subdivided chamber includes an aperture having beveled edges, as aforesaid.

As may be evident in the case of the subdivided air chambers, the elongated apertures into each of the sub-chambers will be distributed circumferentially around the instrument. The circumferential distribution of the apertures will, of course, depend on the nature of the subdivisions and their number. Moreover, the apertures may be provided in rows of circular openings having beveled edges with a bevel angle of 30°, as described above, and further, the apertures whether in the form of an elongated aperture or a row of circular openings may extend obliquely to the axial direction of the instrument.

Accordingly, an object of the present invention is an improved melody bird instrument for achieving melodious and harmonious sounds, resembling those of tropical birds and insects.

A further object of the present invention is an improved construction for a melody bird instrument for achieving a wide variety of melodious and harmonious sounds, including those of a number of different birds, both tropical and domestic, and animals and insects.

It is a still further object of the present invention to achieve an improved melody bird instrument in which a plurality of axially aligned air chambers, each having at least one opening with beveled edges having a bevel angle of 30° into the interior of the air chamber, is provided.

Another object of the present invention resides in an improved melody bird instrument in which a construction of a plurality of axially aligned air chambers, each having at least one opening with beveled edges having a bevel angle of 30°, are provided in the form of cylindrical air chambers, conical air chambers, and/or a combination of cylindrical and conical air chambers.

These and other objects, features, and advantages of the present invention will become more apparent from the following description when taken in connection with the accompanying drawing figures, which show for purposes of illustration only several embodiments in accordance with the present invention, and wherein:

FIG. 13 illustrates a further embodiment of the improved melody bird instrument of the present invention;

FIG. 14 illustrates a partial cross-sectional view through lines XIII—XIII of FIG. 13;

FIG. 15 illustrates a cross-sectional view through lines XV—XV of FIG. 13;

FIG. 16 illustrates a cross-sectional view of FIG. 13;

FIG. 17 illustrates a partial, cut-away cross-sectional view of FIG. 13;

FIG. 23 illustrates a still further embodiment of the improved melody bird instrument in accordance with the present invention, FIG. 24 illustrates a partial cross-sectional view through lines XXIV—XXIV of FIG. 23;

FIG. 25 illustrates a cross-sectional view along lines XXV—XXV of FIG. 23;

FIG. 26 illustrates a cross-sectional view of the structure of FIG. 23;

FIG. 27 illustrates a partial, cut-away cross-sectional view of FIG. 23;

Figure 1:
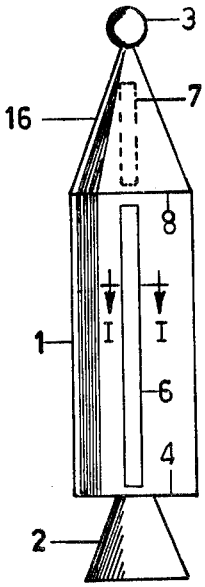
FIG. 1 illustrates an elevational view of the improved melody bird instrument of the present invention.
Figure 1A:
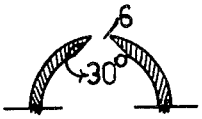
FIG. 1A illustrates in partial cross-section a portion of FIG. 1 through lines I—I.
Figure 2:
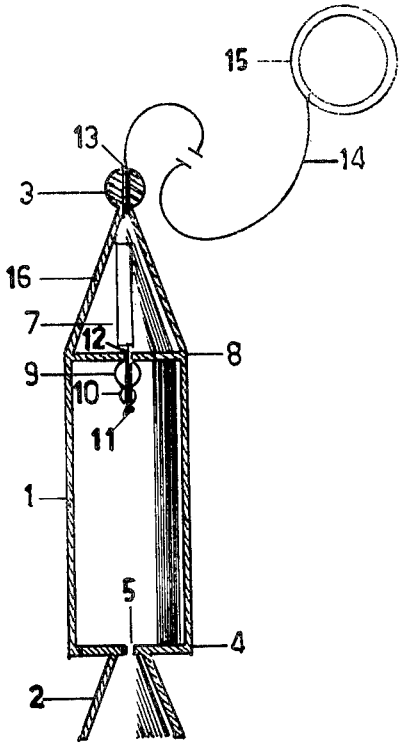
FIG. 2 illustrates in partial, cut-away, cross-section the device of FIG. 1.

Referring to the drawings, wherein like reference numerals are used throughout the various views to designate like parts. FIGS. 1 and 2 illustrate a construction for the improved melody bird instrument of the present invention which has a resemblance to a rocket or satellite. Thus, a central cylindrical air chamber 1 of about 2 inches long and about 13/16 inches in diameter is provided with end walls 4 and 8, and includes an elongated aperture 6 being approximately $1\frac{7}{8}$ inches long and $\frac{1}{8}$ inch wide. The elongated aperture includes a pair of beveled edges, each having a bevel angle of 30° into the interior of the chamber, as is illustrated in FIG. 1A.

A base conical member 2 in the form of a truncated cone is attached to the cylindrical base wall 4 and communicates with the central cylindrical chamber 1 by means of a small aperture having an approximately 1/16 diameter, which aperture 5 serves for air intake and exhaust to produce a diversity of sounds. A further conical member 16 having a base of 13/16 inch diameter and an altitude of 1 1/16 inches is attached to the wall 8 of the cylindrical chamber 1. This conical member 16 includes an elongated aperture 7 which also includes beveled edges with a bevel angle of 30° into the interior of the conical member, similar to that illustrated in FIG. 1A.

In accordance with one feature of the improved melody bird instrument of the present invention, the elongated aperture 7 for the conical member 16 is located at a circumferential location opposite to that of the elongated aperture 6 for the cylindrical member 1. That is, as may be seen from the illustration of FIG. 1, for example, the elongated aperture 6 is at one side of the instrument, while the elongated aperture 7 is at an opposite circumferential side of the instrument.

The conical chamber 16 communicates with the cylindrical chamber 1 through an aperture 12, which has the same size and function as the aperture 5, but further serves to permit passage of a string member 14 by which the melody bird instrument is attached to a plastic holding ring 15. The string 14 passes through a bore 13 in the 3/16 to $\frac{1}{4}$ inch diameter plastic ball 3 at the end of the instrument. The string 14 then passes through the aperture 12, a 3/16 inch diameter plastic ball 9, and a 3/32 inch diameter plastic ball 10 whereupon the string is knotted in the knot 11. This arrangement provides attachment of the string to the instrument so that rotation about the longitudinal axis can be achieved without tangling of the string, while stability is maintained.

Figure 42:
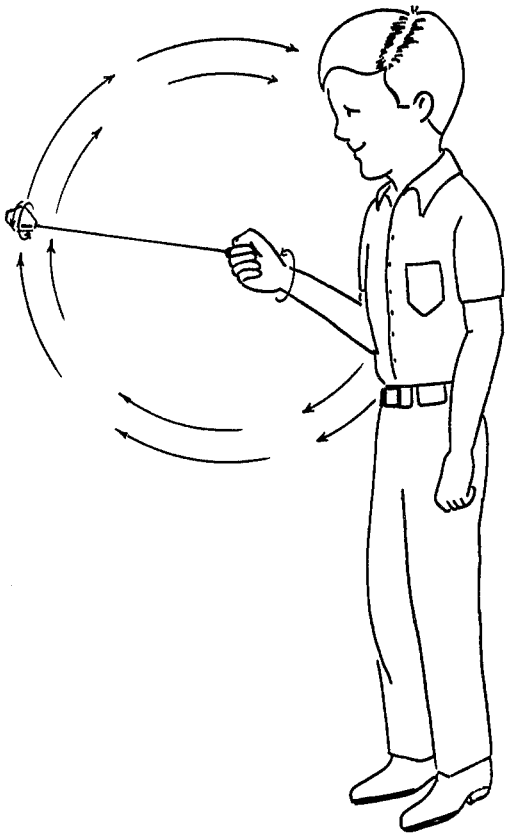
FIG. 42 illustrates an example of operation of the improved melody bird instrument in accordance with the present invention.
Figure 43:
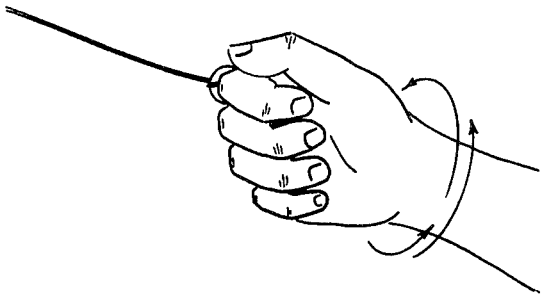
FIG. 43 illustrates the movement of the user's hand in operation of the improved melody bird instrument in accordance with the present invention.

The string 14 is of a strong polyester fiber or nylon thread of approximately 1/64 inch in diameter and of considerable length, such as approximately 34 inches. The plastic holding ring is approximately of 1 inch inside diameter and about $\frac{1}{8}$ inch thick, and enables a user to hold the instrument and place it into operation, as illustrated in FIGS. 42 and 43.

Figure 3:
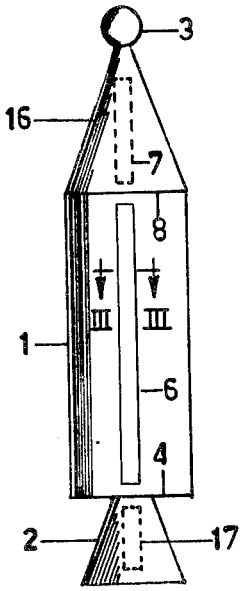
FIG. 3 illustrates a further example of an improved melody bird instrument in accordance with the present invention.
Figure 3A:
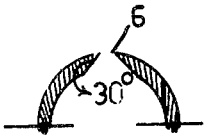
FIG. 3A illustrates a partial cross-sectional view through lines III—III of FIG. 3.
Figure 4:
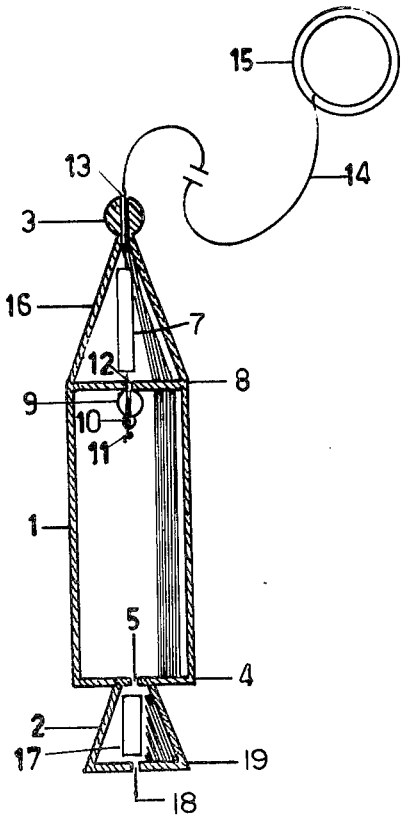
FIG. 4 illustrates a partial, cut-away cross-sectional view of the device of FIG. 3.

FIGS. 3 through 4 illustrate a further arrangement of the device in FIG. 1, particularly in which the conical member 2 forms a closed, truncated conical air chamber having an elongated aperture 17, also including beveled edges with a bevel angle of 30°. The elongated aperture 17 is disposed at the same side of the instrument as the aperture 7, being circumferentially disposed at an opposite side to the aperture 6.

The truncated conical air chamber 2 is closed at a larger diameter conical base 19, which is provided with the small aperture 18. Small aperture 18 has a diameter of approximately 1/16 inch, and serves for air intake and exhaust to produce a diversity of sounds.

The remaining structure and features of the instrument in FIGS. 3 through 4 are similar to those described above with respect to FIGS. 1 through 2, and all of the description therewith is applicable to the embodiment of FIGS. 3 through 4, particularly where like reference numberals describe like elements.

Figure 5:
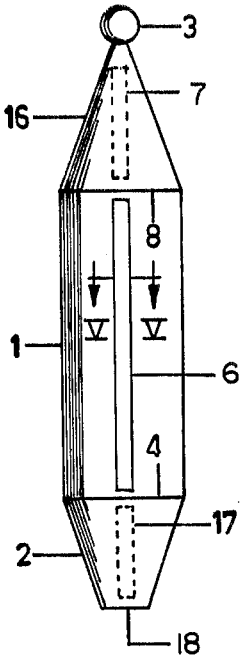
FIG. 5 illustrates another arrangement of the improved melody bird instrument of the present invention.
Figure 5A:
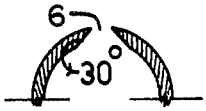
FIG. 5A illustrates a partial cross-sectional view through lines V—V of FIG. 5.
Figure 6:
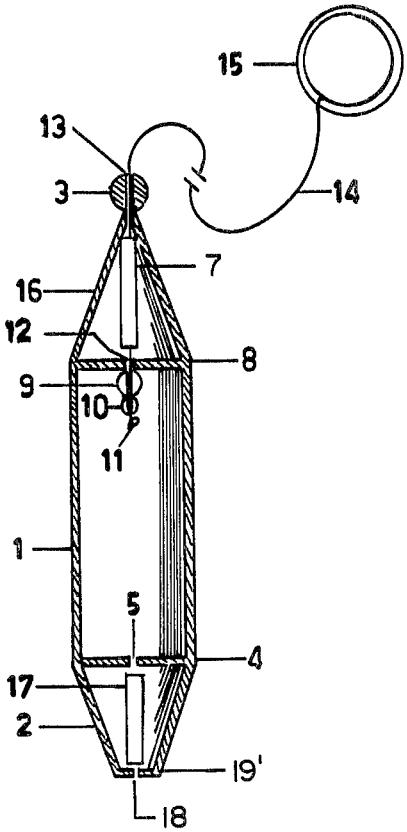
FIG. 6 illustrates a partial, cut-away cross-sectional view of Figure.

FIGS. 5 through 6 illustrate an improved melody bird instrument in accordance with the present invention which also is constructed with a resemblance to a rocket satellite or space capsule. In this construction, which is similar to that described in FIGS. 1 through 4, the truncated conical air chamber 2 is disposed with the larger diameter conical base of the truncated cone being at the wall 4 of the central cylindrical chamber 1. The truncated conical air chamber 2 also has an elongated aperture 17, similar to that described in FIGS. 3 through 4, and also is located circumferentially opposite to the elongated aperture 6 of the central cylindrical chamber 1.

The truncated conical air chamber 2 is closed at the small diameter conical base 19' which has small aperture 18 therethrough similar to FIGS. 3 through 4. This aperture 18 serves with the elongated aperture 17 to permit entry and exhaust of air relative to chamber 2.

The remaining structural features of the arrangement in FIGS. 5 through 6 are similar to those previously described, which are fully applicable to FIGS. 5 through 6.

Figure 7:
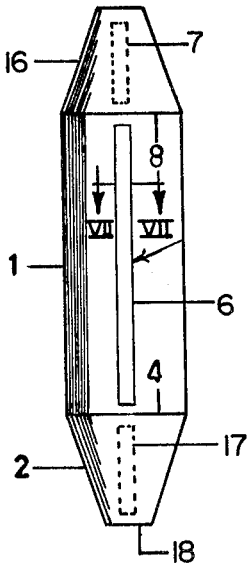
FIG. 7 illustrates another example of the improved melody bird instrument of the present invention.
Figure 7A:
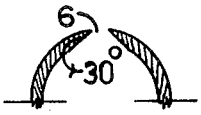
FIG. 7A illustrates a partial cross-sectional view through lines VII—VII of FIG. 7.
Figure 8:
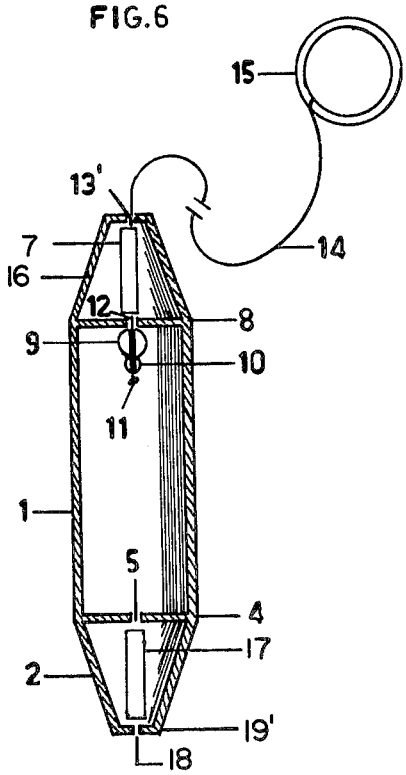
FIG. 8 illustrates a partial, cut-away cross-sectional view of the device of FIG. 7.

FIGS. 7 through 8 illustrate a modification of the arrangement in FIGS. 5 through 6, wherein the conical air chamber 16 is provided in the form of a truncated conical air chamber. In this arrangement, the smaller dimeter conical base of the chamber 16 is provided with the aperture 13' for passage of the string 14, as well as serving to allow air circulation into and out of the chamber 16, in a manner similar to the aperture 5.

Each of the truncated conical air chambers 2 and 16 are provided with respective elongated apertures 17 and 7, both of which have beveled edges with a bevel angle of 30°. Each of these elongated apertures 7 and 17 are approximately ⅛ inch wide and ⅝ inch long, and as may be seen in FIGS. 7 through 8, are located circumferentially opposite to the elongated aperture 6 of the central cylindrical chamber 1.

The arrangement of the two truncated conical air chambers 2 and 16 at the opposite ends 4 and 8 of the central cylindrical air chamber 1 provides a symmetrical construction of the device, as illustrated in FIGS. 7 through 8. This instrument is operated similar to that described above, and includes similar constructional features to that previously described, particularly relative to like reference numerals indicating like elements.

Figure 9:
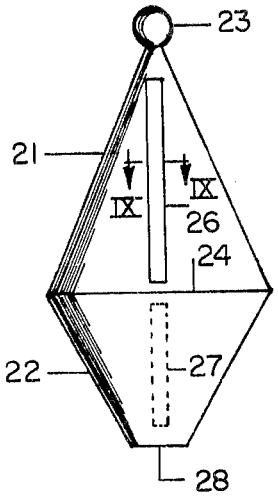
FIG. 9 illustrates another embodiment of the improved melody bird instrument of the present invention.
Figure 10:
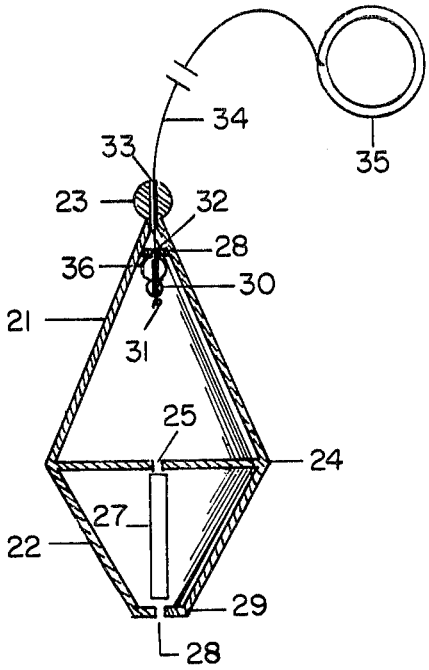
FIG. 10 illustrates a partial, cut-away cross-sectional view of the FIG. 9.

FIGS. 9 through 10 illustrate a construction of the improved melody bird instrument of the present invention which has a similarity to a space capsule by virtue of two conical air chambers 21 and 22 being attached together at the separating partition 24. The conical air chamber 21 has a base diameter of approximately 1½ inches, and sides of approximately 2 inches in length, which extend to an apex where a 3/16 inch plastic ball 23 is located. The diameter of this plastic ball 23 should not be larger than about ¼ inch, so as to serve as a safety element, similar to the plastic ball 3 in the preceding embodiments.

The conical air chamber 22 is in the form of a truncated cone having a larger diameter conical base of 1½ inches disposed at the separating wall 24, and a smaller diameter conical base 29 of about ⅜ inch with a 1/16 inch diameter aperture 28 providing passage for the air. This truncated conical chamber has an altitude or height of about 1 1/16 inches.

Figure 9A:
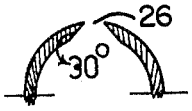
FIG. 9A illustrates a partial cross-sectional view through the lines IX—IX in FIG. 9.

The separating partition 24 is provided with an aperture 25 having an approximately 1/16 inch diameter which serves for air intake and exhaust to produce a diversity of sounds, similar to the aperture 5 described above. Each of the conical air chambers 21 and 22 are provided with elongated apertures 26 and 27, respectively, which are disposed at opposite circumferential sides of the device. Both apertures 26 and 27 have beveled edges with a bevel angle of about 30°, as indicated in FIG. 9A.

The ball 23 is provided with a bore 33 through which the string 34, similar to the above described string 14, passes. This string passes through an aperture 32 in a circular plate 28 at the top of the conical air chamber 21, and further the string 34 passes through a 3/16 diameter plastic ball 36 and a 3/32 diameter plastic ball 30 to be knotted at the knot 31. The plastic ball 30 is provided with a bore of a 1/32 inch diameter through which the string passes so as to serve as a fulcrum or pivot for the instrument.

The string 34 is attached to a plastic holding ring 35, similar to the ring 15 described above.

The elongated aperture 26 in the chamber 21 is approximately ⅛ inch wide and 1⅜ inches long, while the aperture 27 in the conical chamber 22 is approximately ⅛ inch wide and 13/16 inch long. As noted above, these respective apertures are disposed at circumferentially opposite sides of the instrument.

Figure 11:
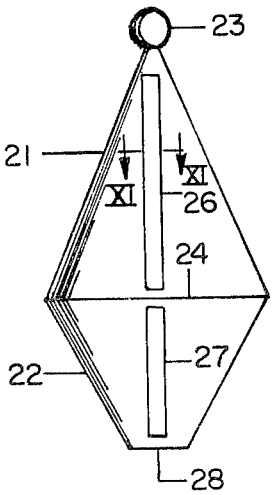
FIG. 11 illustrates a modification of the structure of FIG. 9.
Figure 11A:
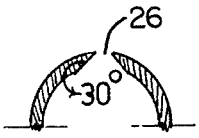
FIG. 11A illustrates a partial cross-sectional view through lines X—XI of FIG. 11.
Figure 12:
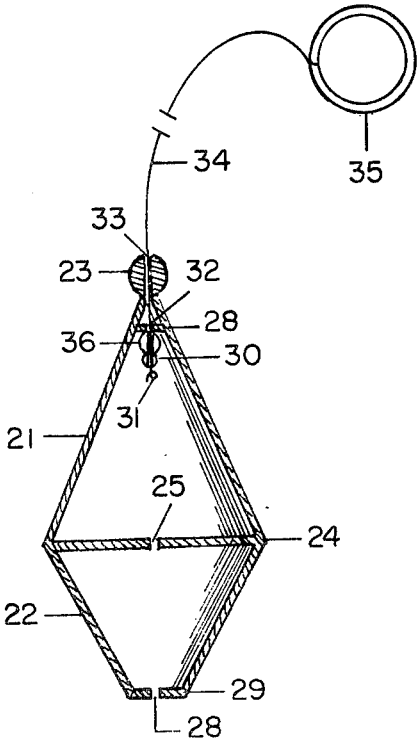
FIG. 12 illustrates a cross-sectional view of FIG. 11.

FIGS. 11 through 12 illustrate a modification of the improved melody bird instrument in FIGS. 9 through 10. Namely, in this arrangement of FIGS. 11 through 12, the elongated apertures 26 and 27 are both at the same circumferential side of the instrument.

All remaining aspects and features are the same as that described above for FIGS. 9 through 10, particularly relative to like reference numerals.

The construction in FIGS. 13 through 17 also involves conical air chambers similar to those described in FIGS. 9 through 12. In this arrangement, however, the truncated conical air chamber 42 with its larger diameter conical base being disposed at the separating wall 44 has a smaller diameter than the diameter of the conical base of the conical air chamber 41. Thus, the conical base of the air chamber 41 at the separating wall 44 may be approximately 1½ inches in diameter, while the larger conical base of the air chamber 42 at the separating wall 44 may have a diameter of 1¼ inches. The smaller conical base 49 of the chamber 42 may have a diameter of about ⅜ inch in diameter and be provided with a small aperture of 1/16 inch diameter for the entry and exit of air.

The respective conical chambers 41 and 42 include elongated apertures 46 and 47, each being provided with beveled edges having a bevel angle of 30°. Moreover, the aperture 47 is disposed on the circumferential opposite side of the instrument from the aperture 46. A small aperture 45 of 1/16 inch diameter is provided in communication between the chambers 41 and 42 through the wall 44.

The string 54 and plastic finger ring 55 are attached to the instrument by way of the plastic ball 43 at the apex of the conical chamber 41, as well as by the plastic balls 50 and 56 and the knot 51, as illustrated in FIG. 16. This construction is similar to that described with respect to FIG. 10, for example.

The construction of similar parts is the same as that previously described, for example, in FIGS. 9 through 12, as may be seen by comparison with the illustrations.

FIGS. 18 through 22 illustrate an arrangement of the improved melody bird instrument of the present invention, somewhat similar to that in FIGS. 9 through 12, but wherein both conical air chambers 61 and 62 are in the form of truncated cones. In this respect, the truncated conical chambers 61 and 62 may be symmetrical with respect to one another and adjoined at separating wall 64 by their larger diameter conical bases. The respective smaller diameter conical bases 73 and 68 of the chambers 61 and 62, respectively, each has a diameter of about ½ inch, and each includes a small aperture 72, 69 of about 1/16 inch diameter for accommodating circulation of the air.

Through one of these small apertures, such as 72 in the drawing figures, the string 74 passes by which the instrument is attached to the plastic holding ring 75 by the use of the plastic balls 76 and 70, as well as the knot 71.

The separating wall 64 between the two conical chambers 61 and 62 is provided with a small aperture 65, also having a 1/16 inch diameter.

Figure 18:
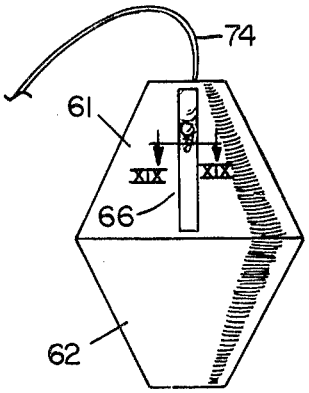
FIG. 18 illustrates still another embodiment of the improved melody bird instrument of the present invention.
Figure 19:
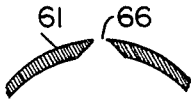
FIG. 19 illustrates a partial cross-sectional view through lines XIV—XIV of FIG. 18.
Figure 22:
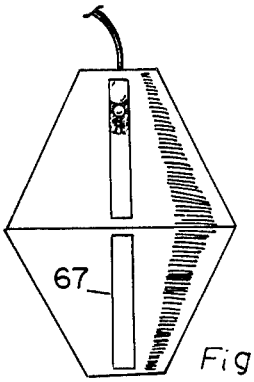
FIG. 22 illustrates a modification of the instrument according to FIG. 18.
Figure 20:
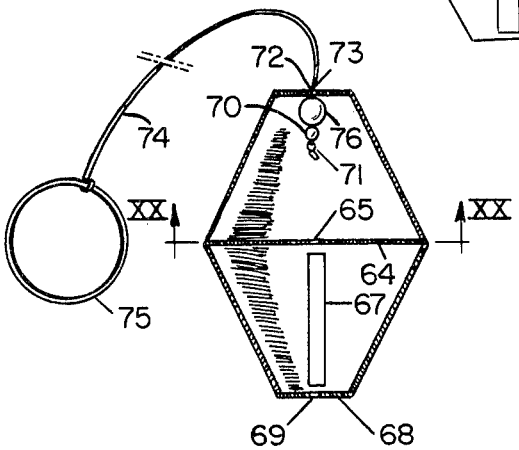
FIG. 20 illustrates a partial, cut-away cross-sectional view of the device of FIG. 18.
Figure 21:
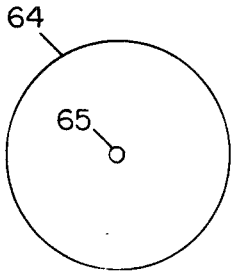
FIG. 21 illustrates a cross-sectional view through lines XX—XX of FIG. 20.

Each of the conical chambers 61 and 62 is provided with elongated apertures 66 and 67, respectively. These elongated apertures have beveled edges with a bevel angle of about 30°, as may be seen by reference to FIG. 19, for example. Moreover, the respective elongated apertures 66 and 67 may be disposed at circumferentially opposite sides of the instrument, as illustrated in FIGS. 18 and 20, or on the same circumferential side of the instrument, as illustrated in FIG. 22.

FIGS. 23 through 27 illustrate a further embodiment of the improved melody bird instrument of the present invention, wherein two conical air chambers 81 and 82 are axially disposed with their apices in the same direction along the axis. That is, the conical air chamber 82 is attached to the conical air chamber 81 with the smaller diameter conical base of the chamber 82 adjoining the larger diameter conical base of the chamber 81. This occurs at the separating wall 84, which also includes the small aperture 85 of 1/16 inch diameter communicating the chambers 81 and 82.

Moreover, as may be noted in the drawing figures, the respective elongated apertures 86 and 87 are disposed at circumferentially opposite sides of the instrument. Each of these elongated apertures includes beveled edges with a bevel angle of 30°, as may be seen in FIG. 24, for example.

The remaining constructional features of this embodiment of the present invention may be described by reference to the preceding description of similar embodiments, wherein like parts are similarly constructed.

Figure 28:
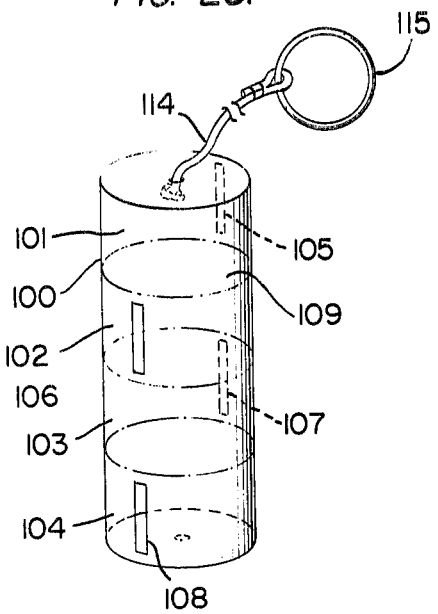
FIG. 28 illustrates in partial, cross-sectional perspective view a further embodiment of the improved melody bird instrument in accordance with the present invention.

Another embodiment of the present invention is illustrated in FIG. 28, which provides a plurality axially aligned cylindrical chambers 101, 102, 103 and 104 to form the improved melody bird instrument 100 of the present invention. In the same manner as described above, this instrument 100 is attached through the string 114 to a plastic holding ring 115, similar to those previously described for operating the instrument.

The respective cylindrical air chambers are each provided with elongated apertures 105, 106, 107 and 108, respectively, which all have beveled edges with a bevel angle of 30°. Moreover, as may be seen from FIG. 28, the elongated apertures of each adjoining cylindrical air chamber are disposed on opposite circumferential sides of the instrument 100. Alternatively, of course, the elongated apertures for each cylindrical chamber could be provided on the same circumferential side of the instrument.

Each cylindrical chamber is separated from the adjoining chamber by means of separating 109 perpendicular to the axis of the instrument. In addition, end walls similar to the separating walls 109. are provided at the opposite axial ends of the cylindrical instrument, and all of the end walls and separating walls may be provided with small apertures of 1/16 inch diameter for enabling circulation of the air.

Figure 29:
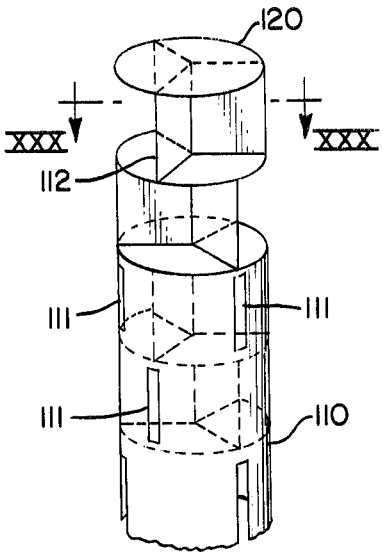
FIG. 29 illustrates an arrangement of partition walls for subdividing the structure of FIG. 28, for example.

FIG. 29 illustrates a partition assembly for an improved melody bird instrument in accordance with the present invention which is a cylindrical device 110, similar to FIG. 28, but with the plurality of axially aligned air chambers being subdivided by means of the subdivision partition 112. In the arrangement of FIG. 29, as may be seen in FIG. 30, the walls 112 are disposed at 120° from one another about the axis of the instrument, so as to define three sub-chambers within each of the plurality of axially aligned air chambers.

Figure 30:
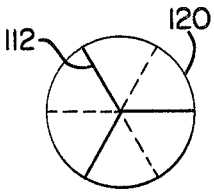
FIG. 30 illustrates a cross-sectional view along line XXX—XXX in FIG. 29.

Moreover, as may be seen by comparison of FIGS. 29 and 30, the separating walls 112 in adjoining ones of the radially aligned air chambers are disposed at 60° with respect to one another so that the sub-chambers in one chamber are rotated by 60° from the sub-chambers in the next adjoining chamber. The apertures 111 provided for each sub-chamber are consequently disposed circumferentially around the instrument for the respective sub-chambers, and are rotated relative to one another with respect to adjoining chambers.

The elongated apertures 111 for each of the chambers or sub-chambers have beveled edges with a bevel angle of 30°, as is the case with the preceding constructions of the present improved melody bird instrument.

Alternatively to the rotation of the walls 112 with respect to adjoining cylindrical chambers, the walls 112 can be aligned throughout the length of the cylindrical instrument 110, or can be variously rotated as desired. The apertures 111 would be disposed correspondingly to the sub-chambers that were created.

Moreover, the number of partition walls 112 within each cylindrical chamber could be varied between adjoining chambers.

Figure 31:
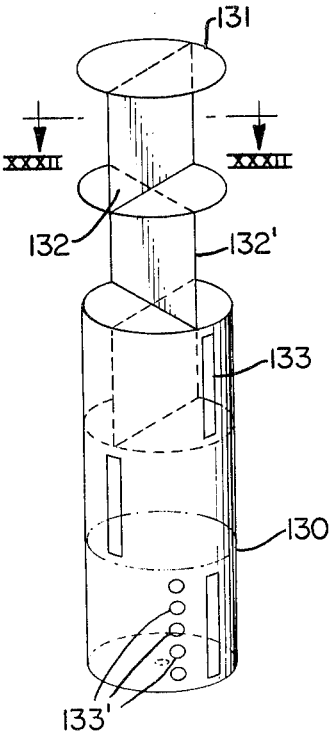
FIG. 31 illustrates another arrangement of partition walls for subdividing the structure of FIG. 28.
Figure 32:
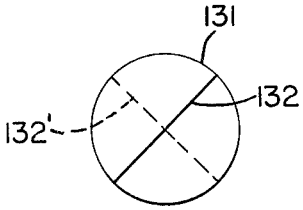
FIG. 32 illustrates a cross-sectional view through line XXXII—XXXII of FIG. 31.

FIGS. 31 and 32 illustrate a further arrangement for a partition assembly 131 in which one partition wall 132 is disposed relative to each of the cylindrical chambers in the cylindrical device 130, which is similar to the instrument 100 in FIG. 28. Each of the resulting sub-chambers from the partition 132 includes an aperture 133 having beveled edges with a bevel angle of 30°.

In addition, as is further illustrated in FIG. 31, the apertures into each air chamber or sub-chamber may be a row of circular openings 133', each of the circular openings having beveled edges with a bevel angle of 30° into the interior of the device.

FIG. 32 illustrates that the partition wall 132 may be at right angles to another succeeding partition wall 132' in a further chamber. That is, the partition walls 132 need not be axially aligned, as in the case in FIG. 31, but can be at right angles, or even at any angular disposition wherein the respective partition walls 132 and 132' divide a corresponding air chamber into two sub-chambers.

Figure 33:
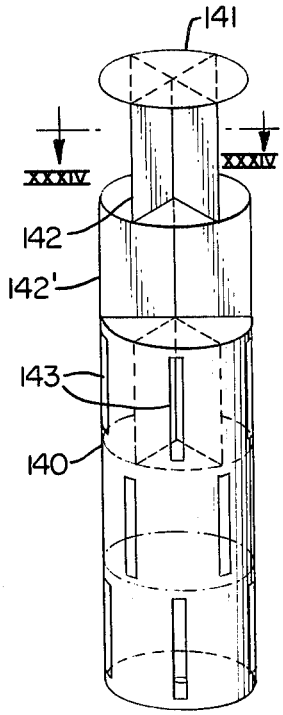
FIG. 33 illustrates a still further arrangement of partition walls for subdividing the structure of FIG. 28.
Figure 34:
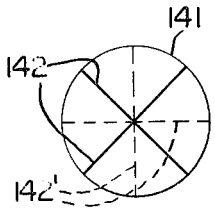
FIG. 34 illustrates a cross-sectional view along line XXXIV—XXXIV of FIG. 33.

FIG. 33 involves a further partition assembly useful in an improved melody bird instrument in accordance with the present invention, which is of a cylindrical type 140, similar to the cylindrical device 100, described in FIG. 28. As may be seen from FIG. 33, as well as comparison with FIG. 34, the partition assembly 141 includes four partition walls 142, which divide each air chamber into four sub-chambers. Moreover, the partition walls 142 in one chamber may be rotated with respect to the partition walls 142' in the next chamber, such as by 45°, as may be seen in the drawing figures. Of course, the respective partition walls in adjoining air chambers may be axially aligned or rotated by any angle with respect to one another, so long as the air chamber is subdivided into four sub-chambers.

On the other hand, the partition walls 142 in one air chamber may be combined with the partition walls 112, such as in FIG. 29, for another air chamber, and further be combined with the partition wall 132, such as in FIG. 31, so as to form a partition assembly which partitions respective air chambers into four sub-chambers, three sub-chambers, or two sub-chambers. Needless to say, one of the air chambers need not be subdivided at all.

In any event, whatever number of sub-chambers are provided within the air chamber, elongated apertures 143 having beveled edges with a bevel angle of 30° into the interior of the sub-chamber are provided for each sub-chamber. The location of the apertures 143 are circumferentially rotated about the outer surface of the device 140 in correspondence to the position of the sub-chambers within the device 140.

Figure 35:
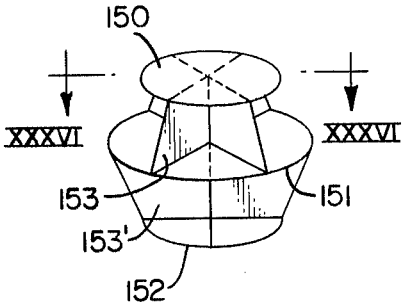
FIG. 35 illustrates an arrangement of partition walls for subdividing adjoining conical air chambers in accordance with the improved melody bird instrument of the present invention.
Figure 36:
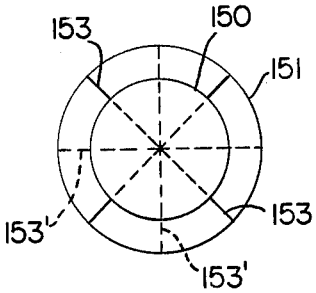
FIG. 36 illustrates a view looking in the direction of line XXXVI—XXXVI of FIG. 35.
Figure 37:
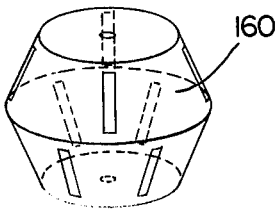
FIG. 37 illustrates an arrangement of the conical air chambers with apertures relative to sub-chambers provided by the partition wall arrangement of FIG. 35.
Figure 38:
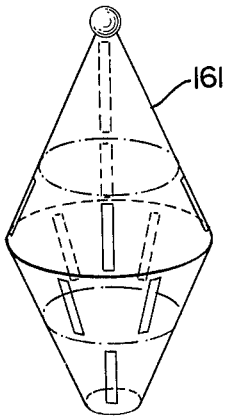
FIG. 38 illustrates another arrangement of conical air chambers utilizing the partition wall arrangement of FIG. 35.

FIGS. 35 and 36 illustrate a partition assembly which is useful in an improved melody bird instrument in accordance with the present invention, of the type having axially adjoining conical air chambers, for example, as seen in FIGS. 37 and 38. The partition assembly in FIG. 35 includes end partitions 150 and 152 with a central partition 151, each being perpendicular to the axis of the instrument so as to divide axially the conical air chambers into a further plurality of axial chambers, as may be seen by reference to FIG. 38, for example.

The partition assembly in FIG. 35 further includes partition walls 153 and 153' which will subdivide respective conical air chambers into four sub-chambers, in the embodiment of FIGS. 35 36. Again, the partition walls 153 and 153' may be rotated about the axis of the device with respect to one another, as may be seen from FIG. 36, or may be axially aligned between the two separated conical air chambers.

Each of the sub-chambers formed by the partition assembly in FIG. 35 includes apertures, such as may be seen in FIGS. 27 and 38, with the apertures having beveled edges with a bevel angle of 30° into the interior of the sub-chambers in accordance with the features of the present invention.

Figure 39:
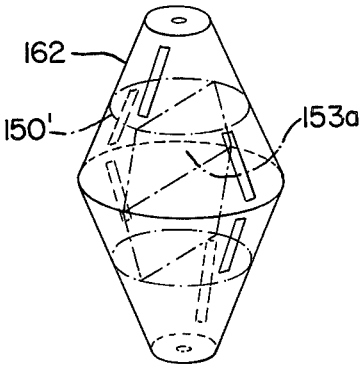
FIG. 39 illustrates another example of a conical air chamber arrangement with a different partition wall arrangement.

FIG. 39 shows a further partition assembly which may be useful in a truncated conical air chamber melody bird instrument, wherein prtition walls **153*a* subdivide the conical air chambers into two sub-chambers. Moreover, the partition assembly includes upper wall 150' perpendicular to the axis of the device, as well as a corresponding lower wall, also perpendicular to the axis of the device, so as to divide each truncated conical air chamber 162** into two further truncated conical air chambers. All of the chambers and sub-chambers are provided with elongated apertures, which have beveled edges with a bevel angle of 30° into the interior of the chambers.

Figure 40:
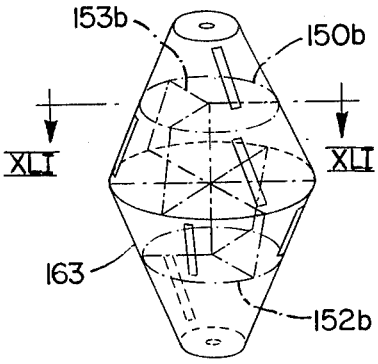
FIG. 40 illustrates a still further conical air chamber arrangement with a still further partition wall arrangement in accordance with the present invention.
Figure 41:
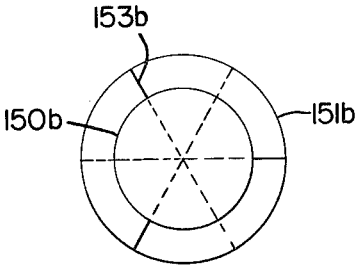
FIG. 41 illustrates a cross-sectional view through lines XLI—XLI of FIG. 40.

FIGS. 40 and 41 illustrate a partition assembly for a truncated conical melody bird instrument 163 in which the partition walls **153*b* subdivide the conical air chambers into three sub-chambers, while also the end walls 150*b* and 152*b* divide each truncated conical air chamber into two further truncated conical air chambers, particularly as may be seen in FIG. 40**.

Respective elongated apertures, each having beveled edges with a bevel angle of 30° into the interior of the respective chambers or sub-chambers are provided in this instrument 163 in accordance with the arrangement of the present invention.

Again, with respect to the conical type melody bird instruments of the present invention, the partition assemblies may subdivide the conical air chambers into any number of partitions, and the adjoining air chambers may have the partition walls axially aligned or rotated with respect to one another. Further, the apertures into each chamber or sub-chamber may be elongated apertures, such as described, or may include rows of circular openings, each having beveled edges with a level angle of 30° into the interior of the chamber, as discussed above. Moreover, the apertures may extend axially, or may be oblique to the axis.

Further, the pair of truncated conical air chambers, such as those in FIGS. 37, 39, and 40, for example, may be provided with rounded edges so as to be in the form of an ovate having an ovoidal or egg-shape. With such an exterior form of the melody bird instrument in accordance with the present invention, the interior air chambers are provided in axially aligned air chambers, which may be further subdivided. Each of the chambers or sub-chambers include apertures having beveled edges with a bevel angle of 30° into the interior of the chambers or sub-chambers in the manner of the previously described devices.

The manner of operating the improved melody bird instrument in accordance with the present invention may be seen by reference to FIGS. 42 and 43, wherein the instrument is rotated about its longitudinal axis and further swung through the air. This motion of the instrument causes air to circulate through the air chambers, thereby producing whistles and echoes within the walls of the air chambers so that a variety of melodious and harmonious sounds are achieved. Variations may be provided, as in the case of my above-mentioned copending application, by varying the motion of the wrist and arm such as by providing soft or strong pulls on the string.

Each of the various instruments described above, may be constructed of thin metal which is formed in the appropriate shape and soldered in place, or may be constructed of plastic materials being suitably fashioned. In addition, the provision of a long thin plastic tail joined to the instrument further achieves a wind sound upon operation of the device.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. In an instrument for simulating sounds of singing birds and nighttime animals and insects, said instrument comprising air chamber means for circulating air therethrough upon relative movement between said air chamber means and air, said air chamber means including aperture means having at least one opening for said air chamber means, said at least one opening being providing with beveled edges having a bevel angle of 30° into the interior of said air chamber means, and means for controlling movement of said air chambers means with respect to air, the improvement comprising said air chamber means including a plurality of axially aligned air chambers, each of said plurality of air chambers having at least one of said openings.

2. An instrument according to claim 1, wherein at least one of said plurality of air chambers is in the form of a cylinder.

3. An instrument according to claim 2, wherein all of said plurality of air chambers are in the form of a cylinder.

4. An instrument according to claim 2, wherein at least one further air chamber is in the form of a cone.

5. An instrument according to claim 4, wherein said cone is a truncated cone.

6. An instrument according to claim 5, wherein two of said further air chambers, each in the form of said truncated cone, are provided at respective opposite axial ends of said air chamber in the form of a cylinder, said two further air chambers in the form of truncated cones each having the base of larger diameter adjoining the ends of said air chamber in the form of a cylinder.

7. An instrument according to claim 4, wherein two of said further air chambers, each in the form of said cone, are provided at respective opposite axial ends of said air chamber in the form of a cylinder, and wherein one of said two further conical air chambers has a base adjoining one axial end of said air chamber in the form of a cylinder and apex directed axially away from said one axial end of said cylindrical air chamber, and a second of said two further conical air chambers is a truncated cone adjoining a second axial end of said cylindrical air chamber.

8. An instrument according to claim 7, wherein said second of said further conical air chambers being said truncated cone has one conical base of smaller diameter than a second base of the truncated cone, which smaller diameter base adjoins said second axial end of said cylindrical air chamber.

9. An instrument according to claim 7, wherein said second of said further conical air chambers being said truncated cone has one base of larger diameter than a second conical base of said truncated cone, which larger diameter base adjoins said second axial end of said cylindrical air chamber.

10. An instrument according to claim 1, wherein said plurality of air chambers includes two conically-shaped air chambers axially adjoining one another.

11. An instrument according to claim 10, wherein one of said two conically-shaped air chambers is a truncated cone.

12. An instrument according to claim 11, wherein said one air chamber being a truncated cone has a first base of smaller diameter than a second base thereof, said first conical base adjoning the second of said two conically-shaped air chambers at a base thereof.

13. An instrument according to claim 12, wherein said first base of said air chamber being a truncated cone is smaller than the diameter of the adjoining base of said second conically-shaped air chamber.

14. An instrument according to claim 11, wherein said one air chamber being a truncated cone has a first base of larger diameter than a second base thereof, said first larger diameter base adjoining the second of said two conically-shaped air chambers at a base thereof.

15. An instrument according to claim 14, wherein said first conical base of said truncated air chamber is substantially the same diameter as the diameter of said base of said second conically-shaped air chamber.

16. An instrument according to claim 14, wherein said first base of said truncated conical air chamber has a diameter less than the diameter of said base of said second concially-shaped air chamber.

17. An instrument according to claim 10, wherein both of said two conically-shaped air chambers are truncated cones, each of said truncated conical air chambers having a first larger diameter base larger than a second smaller diameter base, and wherein said two truncated conical air chambers adjoin at said first larger diameter bases which are substantially of the same diameter.

18. An instrument according to claim 1, wherein said openings in each of said air chambers are elongated openings extending in the axial direction, and wherein said elongated openings for respective adjoining air chambers are disposed at different circumferential locations from each other.

19. An instrument according to claim 1, wherein at least one of said plurality of air chambers is divided into at least two sub-chambers, and wherein each sub-chamber has at least one of said openings.

20. An instrument according to claim 19, wherein said at least one air chamber is divided into three sub-chambers, each having at least one of said openings.

21. An instrument according to claim 19, wherein said at least one air chamber is divided into four sub-chambers, each having one of said openings.

22. An instrument according to claim 19, wherein all of said plurality of air chambers are divided into at least two sub-chambers, each having at least one of said openings.

23. An instrument according to claim 22, wherein adjoning ones of said plurality of air chambers are divided into different numbers of sub-chambers.

24. An instrument according to claim 22, wherein adjoining ones of said plurality of air chambers are divided into the same number of sub-chambers which are respectively axially aligned.

25. An instrument according to claim 22, wherein adjoining ones of said plurality of air chambers are divided into the same number of sub-chambers which are offset from one another about the axis of said instrument.

26. An instrument according to claim 1, wherein said plurality of air chambers are in communication with one another.

27. An instrument according to claim 1, wherein said air chamber means is provided in an ovoidal shape in which said plurality of air chambers is disposed.

28. An instrument according to claim 1, wherein said plurality of air chambers include a centrally disposed air chamber and at least one further air chamber axially disposed at each end of said central air chamber.

29. An instrument according to claim 1, wherein said openings in said air chambers are elongated openings extending obliquely to the axial direction.

30. An instrument according to claim 1, wherein said openings in said air chambers are elongated openings extending in the axial direction, and wherein said elongated openings for respective adjoining air chambers are disposed at the same circumferential side of said air chamber means.

31. An instrument according to claim 1, wherein said openings in said air chambers include a plurality of circular openings axially aligned in a row in each of said air chambers.

* * * * *